US005289174A

United States Patent [19]

Suzuki

[11] Patent Number: 5,289,174

[45] Date of Patent: Feb. 22, 1994

[54] LIQUID CRYSTAL DISPLAY DEVICE

[75] Inventor: Kouji Suzuki, Yokohama, Japan

[73] Assignee: Kabushiki Kaisha Toshiba, Kawasaki, Japan

[21] Appl. No.: 913,069

[22] Filed: Jul. 14, 1992

[30] Foreign Application Priority Data

Jul. 22, 1991 [JP] Japan ..... 3-181256

[51] Int. Cl.[5] ..... G09G 3/36

[52] U.S. Cl. ..... 345/98; 359/59

[58] Field of Search ..... 359/59, 58, 57; 340/784

[56] References Cited

U.S. PATENT DOCUMENTS 4,621,260 11/1986 Suzuki et al. ..... 340/719

FOREIGN PATENT DOCUMENTS 0461417 12/1991 European Pat. Off. .
61-128291 6/1986 Japan .

OTHER PUBLICATIONS

Institute of Electrical and Electronics Engineers, 1989 International Display Research Conference, 1988, I.E.E.E., "14-IN.—Diagonal Full-Color a-SI TFT LCD", T. Nagayasu, pp. 56-58.

Patent Abstracts of Japan, vol. 14, No. 138(P-1022) Mar. 15, 1990, JP-A-20 03 023, Jan. 9, 1990, Ichimura Teruhiko, et al., "Thin Film Transistor Matrix and Its Manufacture".

Patent Abstracts of Japan, vol. 13, No. 279, (p-891) Jun. 27, 1989, JP-A-10 68 723, Mar. 14, 1989, Iwaki Tetsuo, et al., "Active Matrix Display Panel".

*Primary Examiner*—Alvin E. Oberley
*Assistant Examiner*—Minsun Oh
*Attorney, Agent, or Firm*—Oblon, Spivak, McClelland, Maier & Neustadt

[57] ABSTRACT

An active matrix liquid crystal display device in a normally white mode comprises two bus lines corresponding to pixel electrodes. The bus lines are formed under the pixel electrodes with an insulating layer interposed therebetween. First and second alternating current voltages whose phases differ from each other by 180°, are applied to the bus lines. The first and second voltages satisfies an equation of $C_1 \cdot V_1 = C_2 \cdot V_2$ ($V_1$ and $V_2$ represent first and second voltages, respectively, and $C_1$ and $C_2$ represent capacitances between the bus lines and the pixel electrodes, respectively). A pixel electrode having represented a bright spot defect is short-circuited with one of the bus lines, and the voltage of the bus line is applied to the pixel electrode. The bright spot defect is therefore changed to a dark spot defect.

14 Claims, 5 Drawing Sheets

LIQUID CRYSTAL DISPLAY DEVICE

BACKGROUND OF THE INVENTION

1. Field of the Invention

The present invention relates to a liquid crystal display device and, more particularly, to an active matrix liquid crystal display device in a normally white mode.

2. Description of the Related Art

Characteristics of a liquid crystal display device are that it is thin and light, it can be driven at a low voltage, and display a colored image. This type of device has recently been employed as a display device for a personal computer, a wordprocessor, and the like. In particular, an active matrix liquid crystal display device including a switching element for each of pixels does not deteriorate in contrast or response even though the pixels are increased in number. It allows a half-tone display and is the most suitable for use in color television sets and office automation equipment.

FIG. 10 shows a circuit equivalent to a conventional active matrix liquid crystal display device in which thin-film transistors (TFT) are used as switching elements. The liquid crystal display device includes two substrates (an array substrate and an opposed substrate) formed of a transparent insulation material such as glass, and a liquid crystal layer 8 interposed between these substrates. Pixels each having a TFT 3 and a transparent pixel electrode 4 are arranged in matrix on the array substrate. The transparent pixel electrode 4 is connected to the source of the TFT 3, and an address line 1 and a data line 2 are connected to the gate and drain thereof, respectively. An opposed electrode 7 is arranged on the opposed substrate so as to oppose to the transparent pixel electrodes 4. In the liquid crystal display device so constituted, an address signal and a data signal are supplied to the address line 1 and data line 2 at predetermined timing, respectively, with the result that voltages corresponding to display can be selectively applied to the pixel electrodes 4. The orientation of the liquid crystal layer 8—i.e. the light transmittance thereof—can be controlled by a difference in potential between the opposed electrode 7 and pixel electrodes 4, thereby allowing an arbitrary display.

Liquid crystal in a twisted nematic mode is generally used for the liquid crystal layer 8, and a polarizing plate is formed on each of the outer faces of the substrates. Two display modes—a normally white mode and a normally black mode—can be achieved in accordance with the arrangement of the polarizing plate. More specifically, when no voltage is applied to the liquid crystal layer 8, the maximum light transmittance represents the normally white mode, whereas the minimum light transmittance indicates the normally black mode. However, since, in the normally black mode, a slight difference in thickness between liquid crystal layers causes irregularities in the minimum light transmittance, and the thicknesses of the optimum liquid crystal layers differ from one another with the wavelength of light transmitted through the liquid crystal layers, high contrast is difficult to achieve. Therefore, the normally white mode is more frequently used.

The process for manufacturing switching elements such as the TFT is extremely complicated, and it is therefore very difficult to form defect-free pixels; some defective pixels are always included in the finished pixels. Defective pixels include a bright spot defective pixel which cause a bright spot defect on the screen of the liquid crystal display device when the screen is displayed black. The bright spot defective pixel degrades the display quality most. Basically, the the bright spot defect is caused in the liquid crystal display device in the normally white mode in a case where a voltage of a level which would cause the light transmittance of the liquid crystal layer to vary is not applied to the pixel electrode of the defect. Since there are many causes for this, the bright spot defect cannot be completely eliminated even by use of various types of redundant structures.

As described above, the conventional active matrix liquid crystal display device in the normally white mode has a drawback in which its display quality is greatly degraded because of bright spot defective pixels.

SUMMARY OF THE INVENTION

The present invention has been developed in consideration of the above situation and its object is to provide a liquid crystal display device capable of easily changing a bright spot defective pixel to a vanished spot defective pixel which is unnoticeable as a defect.

The essence of the present invention is that one of bus lines to which predetermined voltages are applied can be connected to pixel electrodes, and a voltage drop in a liquid crystal layer due to a voltage drop in the pixel electrodes is compensated for, using the voltage applied to the bus line.

To attain the above object, the liquid crystal display device according to the present invention comprises:

a matrix array substrate including pixel electrodes arranged in matrix, switching elements arranged for the respective pixel electrodes and driven in response to an address signal, and bus lines which are formed under the respective pixel electrodes, with insulation layers interposed therebetween and to which predetermined voltages are applied;

a liquid crystal layer formed on the matrix array substrate; and an opposed substrate including an opposed electrode opposed to the pixel electrodes, with the liquid crystal layer interposed between the matrix array substrate and the opposed substrate, wherein a pixel electrode having represented a bright spot defect is short-circuited with one of the bus lines to which the predetermined voltages are applied.

The bus lines include first and second bus lines to which preferably alternating current voltages, whose phases are opposite to each other, are applied. Assuming that the voltage applied to the first bus line is $V_1$, the voltage applied to the second bus line is $V_2$, the capacitance between the first bus line and the pixel electrode is $C_1$, and the capacitance between the second bus line and the pixel electrode, $C_1 \cdot V_1$ is almost equal to $C_2 \cdot V_2$.

According to the liquid crystal display device of the present invention, if one of the first and second bus lines is short-circuited with the pixel electrode in the event that the voltage of the pixel electrode drops, the voltage drop can be compensated for. If the voltage applied to the bus line is set so that the compensated voltage of the pixel electrode is of a level which reduces the light transmittance of the liquid crystal layer, a bright spot defective pixel can be changed to a dark spot defective pixel which does not affect the display quality so much.

Since the pulse voltages whose phases are opposite to each other or in anti-phase are applied to the first and second bus lines, and the values of $C_1 \cdot V_1$ and $C_2 \cdot V_2$ are almost equal to each other, the influence of the pulse voltages upon the pixels electrodes is canceled in a normal operation, and defect-free pixel electrodes are not influenced by the pulse voltages applied to the bus lines. The reason for this is as follows:

Assuming that the charge stored in a capacitor of capacitance $C_1$ is $Q_1$ and the charge stored in a capacitor or capacitance $C_2$ is $Q_2$, $Q_1 \leqq C_1 \cdot V_1$ and $Q_2 = C_2 \cdot V_2$. Furthermore, since the phases of the pulse voltages are opposite to each other, the charge $\Delta Q$ induced in the pixel electrodes by the pulse voltages is equal to $Q_1 + Q_2 = 0$.

According to the present invention, in a liquid crystal display device in a normally white mode, a bright spot defective pixel which affects display quality the most adversely can be easily changed to a dark spot defective pixel which does not affect the quality so much.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the present invention will now be described, with reference to the accompanying drawings.

Figure 1:
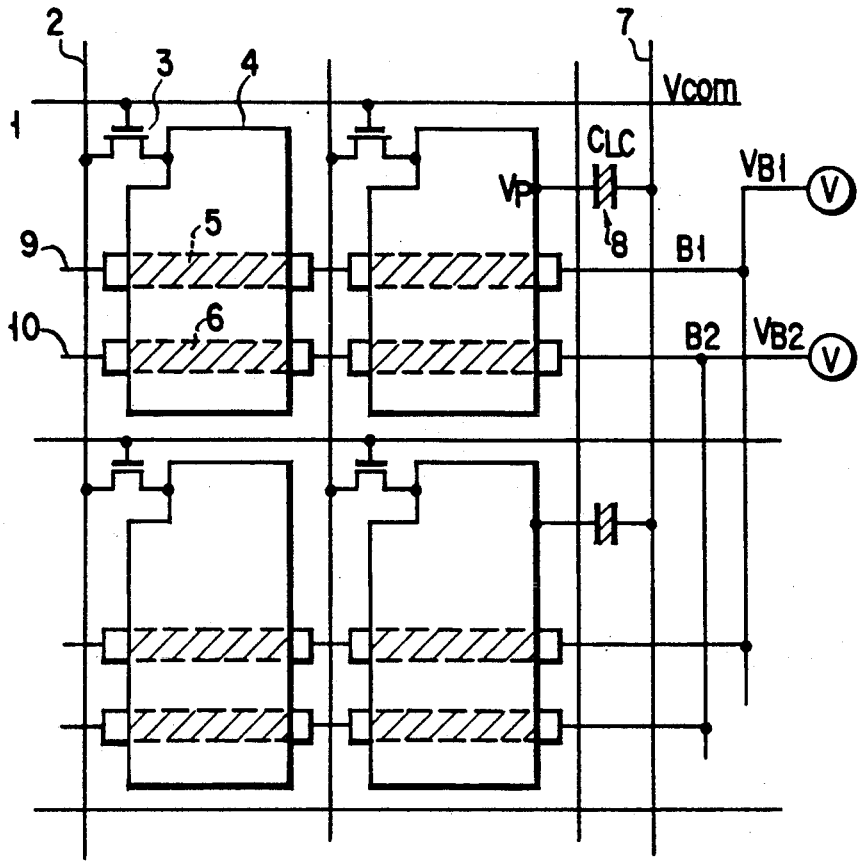
FIG. 1 is a schematic view of an equivalent circuit of a liquid crystal display device according to a first embodiment of the present invention.
Figure 2:
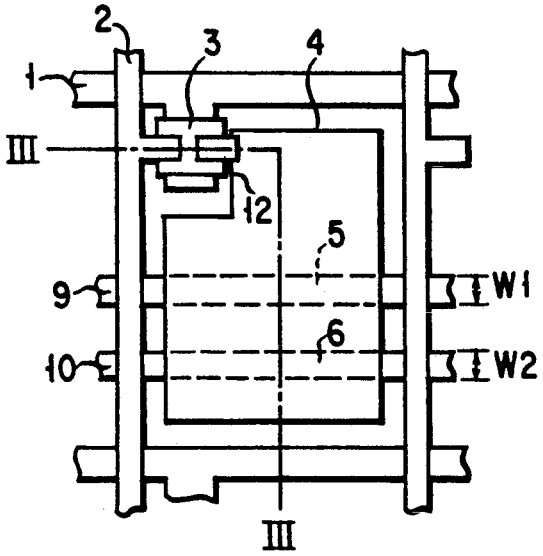
FIG. 2 is a plan view of one pixel of the liquid crystal display device shown in FIG. 1.
Figure 3:
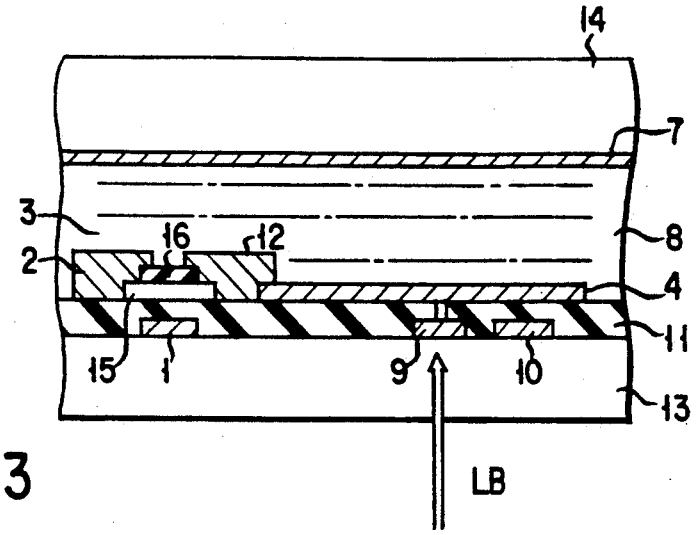
FIG. 3 is a cross-sectional view taken along the line III—III of FIG. 2.

FIGS. 1 to 3 show a liquid crystal display device according to the first embodiment of the present invention. The liquid crystal display device comprises two substrates of a matrix array substrate 13 and an opposed substrate 14 formed of a transparent insulating material such as glass, and a liquid crystal layer 8 interposed between the substrates.

A thin-film transistor (TFT) 3 and capacitors 5 and 6 are formed for one pixel of the liquid crystal display device. The gate of the TFT 3 is connected to an address line 1, the source/drain thereof is connected to a pixel electrode 4 through a connection wiring layer 12, and the other source/drain thereof is connected to a data line 2. The capacitors 5 and 6 are constituted of the pixel electrode 4 and bus lines 9 and 10 formed under an insulating film 11 made of, e.g., silicon oxide.

Figure 4:
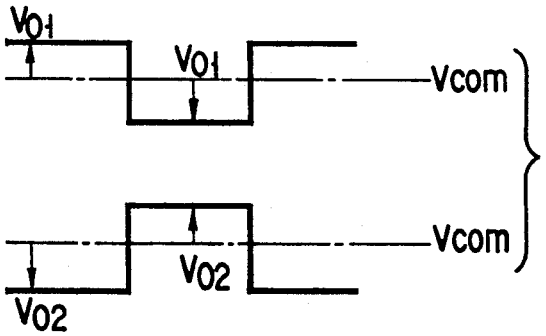
FIG. 4 is a view of waveforms of bias voltages.

The TFT 3 is a reverse stagger TFT whose gate electrode is constituted of part of the address line 1 formed under an active layer 15 with the insulating film 11 interposed between the address line 1 and the active layer 15. The active layer 15 is formed of amorphous silicon. A channel protection film 16 is formed on the active layer 15 to prevent the active layer 15 from being damaged during the manufacture of the TFT. The pixel electrode 4 is formed of transparent indium tin oxide (ITO). The capacitances $C_{S1}$ and $C_{S2}$ of the capacitors 5 and 6 are both 0.15 pF. The bus lines 9 and 10 are thin films of alloy of molybdenum and tantalum, and their widths are both 15 μm. As shown in FIG. 4, alternating current bias voltages $V_{B1}$ and $V_{B2}$ whose central voltages $V_{com}$ are 5 V, amplitudes $V_{01}$ and $V_{02}$ are 4 V, and phases are shifted by 180° to each other, are applied to the bus lines 9 and 10, respectively. The cycles of the bias voltages $V_{B1}$ and $V_{B2}$ are both 30 Hz which corresponds to a value two times as large as a period 1/60 seconds necessary for selecting all the pixels or all the address lines 1 of the liquid crystal display device. If the amplitudes $V_{01}$ and $V_{02}$ of the bias voltages $V_{B1}$ and $V_{B2}$ are larger than that of a voltage at which the light transmittance of the liquid crystal layer starts to change, they need not be 4 V.

A pulse signal voltage whose central voltage is 6 V, amplitude is $V_{sig}$ V, and cycle is 30 Hz, is applied to the data line 2 and, in other words, a voltage, which is able to drive the liquid crystal layer 8 in the positive polarity at one time and in the negative polarity at the next time, is applied thereto. The potential $V_{com}'$ of the opposed electrode 7 is set to 5 V to prevent a DC voltage from being applied to the liquid crystal layer 8.

A normal operation of the liquid crystal display device having the above arrangement will now be described.

When a data signal of $6 \pm V_{sig}$ V is supplied to the data line 2, a selected pulse voltage is applied to the address line 1 in synchronism with the supply of the data signal. Thus the data signal is supplied to the pixel electrode 4 through the TFT 3. When the selected pulse voltage is cut off, switching noise $\Delta V_p$ is generated in the TFT 3, and a pixel electrode potential $V_p$ is shifted. Since the switching noise $\Delta V_p$ is about 1 V, the voltage held in the pixel electrode 4 is $5 \pm V_{sig}$ $(=6 \pm V_{sig} - 1)$ V.

The bias voltages $V_{B1}$ and $V_{B2}$ have different phases which are shifted by 180° to each other, and satisfy the following equation (1).

$$C_{S1} \cdot V_{01} = C_{S2} \cdot V_{02} \quad (1)$$

Consequently, the influence of the bias voltages $V_{B1}$ and $V_{B2}$ is canceled at the pixel electrode potential $V_p$, and the pixel electrode potential is not influenced by the bias voltages. A voltage $\pm V_S$ V corresponding to a difference between the potential of the opposed electrode 7 and pixel electrode potential $V_p$, can thus be applied to the liquid crystal layer 8 and, as in a conventional case, the light transmittance of the liquid crystal layer 8 can be controlled to achieve a desired display.

A method of recovering a bright spot defective pixel of the liquid crystal display device having the above arrangement, will be described. Assume that the connection wiring layer 12 is disconnected, and no voltage is applied to the pixel electrode 4, resulting in a bright spot defective pixel.

A laser beam LB such as a YAG laser beam is emitted from the undersurface of the matrix array substrate 13 to partially damage the bus line 9 and insulating film 11, and the damaged bus line 9 and pixel electrode 4 are short-circuited by the melt of the bus line 9. Since, therefore, the pixel electrode potential $V_p$ is equalized with the bias voltage $V_{B1}$, a pulse voltage of 5±4 V is always applied to the pixel electrode 4. Further, since the potential $V_{com}'$ of the opposed electrode 7 is 5 V, a pulse voltage of ±4 V is applied to the liquid crystal layer 8. Since the light transmittance of the liquid crystal layer 8 is about 1% at ±4 V the bright spot defective pixel is changed to a dark spot defective pixel.

The bias voltages $V_{B1}$ and $V_{B2}$ of the bus lines 9 and 10 may not conform to the equation (1) in a normal display operation because of the capacitance of the liquid crystal layer 8. If, however, the central voltage $V_{com}$ and the amplitudes $V_{01}$ and $V_{02}$ of the bias voltages $V_{B1}$ and $V_{B2}$ can be adjusted, they can satisfy the equation (1) in principle. Even though a few direct current components are applied to the dark spot defective pixel, no problems occur when the light transmittance is considerably low.

In the liquid crystal display device in the normally white mode according to the first embodiment of the present invention, a bright spot defective pixel having the most adverse influence on display quality, can be changed to a dark spot defective pixel having less adverse influence thereon. Since the dark spot defective pixel is driven by alternating current voltage, the liquid crystal layer is not degraded by the change in the defective pixels.

Figure 5:
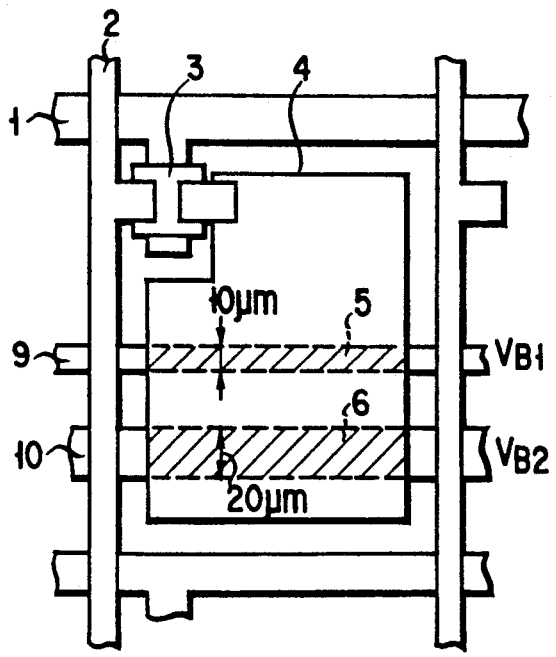
FIG. 5 is a plan view of one pixel of a liquid crystal display device according to a second embodiment of the present invention.

FIG. 5 is a plan view of one pixel of a liquid crystal display device according to the second embodiment of the present invention. In FIG. 5, the elements corresponding to those of the pixel of the first embodiment shown in FIGS. 1 to 3 are denoted by the same reference numerals, and their descriptions are omitted.

The liquid crystal display device of the second embodiment differs from that of the first embodiment in that the widths of the bus lines 9 and 10 are different from each other. The width of the bus line 9 is 10 μm and that of the bus line 10 is 20 μm. The capacitances $C_{S1}$ and $C_{S2}$ of the capacitors 5 and 6 are 0.1 pF and 0.2 pF, respectively. A pulse voltage whose amplitude is 5.0±5.0 V and cycle is 30 Hz, is applied to the bus line 9, whereas a pulse voltage whose amplitude is 5.0±2.5 V and cycle is 30 Hz, is applied to the bus line 10 in anti-phase in relation to that of the pulse voltage applied to the bus line 9. Therefore, the pulse voltages satisfy the equation (1), and no problems arise in the normal display operation of the second embodiment.

A bright spot defective pixel of the second embodiment is recovered, as in the first embodiment. A YAG laser beam is emitted from the undersurface of the matrix array substrate to short-circuit the bus line 9 and pixel electrode 4 and apply a voltage of 5.0±5.0 V to the pixel electrode 4, with the result that the bright spot defective pixel is changed to a dark spot defective pixel.

Since the capacitances $C_{S1}$ and $C_{S2}$ are set to different values in the second embodiment, the amplitude of the pulse voltage applied to the bus line 10 having a capacitor which is larger than that of the bus line 9, can be reduced. A pulse voltage necessary for changing the bright spot defective pixel to the dark spot defective pixel, is applied to the bus line 9.

Figure 6:
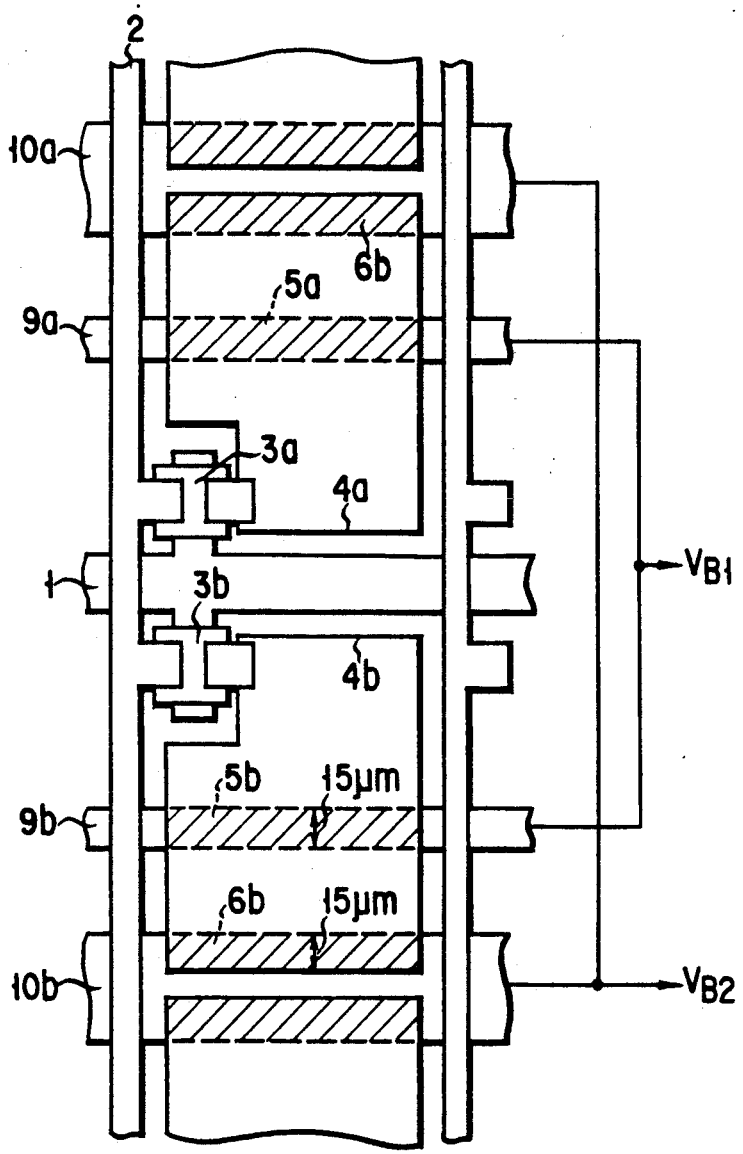
FIG. 6 is a plan view of pixels of a liquid crystal display device according to a third embodiment of the present invention.

FIG. 6 is a plan view of pixels of a liquid crystal display device according to the third embodiment of the present invention. In FIG. 6, the elements corresponding to those of the pixel of the first embodiment shown in FIGS. 1 to 3 are denoted by the same reference numerals, and their descriptions are omitted.

The liquid crystal display device of the third embodiment differs from that of the first embodiment in that a plurality of pixel electrodes are arranged for each pixel. More specifically, one pixel is divided into two sub-pixels, and a switching transistor 3a and a pixel electrode 4a are arranged for one of the sub-pixels and a switching transistor 3b and a pixel electrode 4b are arranged for the other sub-pixel. Bus lines 9a and 10a, and bus lines 9b and 10b are formed under the pixel electrodes 4a and 4b, respectively. The width of each of the bus lines 9a and 9b is 15 μm. The width of an overlap of the bus line 10a and pixel electrode 4a and that of an overlap of the bus line 10b and pixel electrode 4b are both 15 μm. The bus lines 10a and 10b are also used as those of sub-pixels of the adjacent pixels.

Bias voltages each having an amplitude of 5.0±4 V and a cycle of 30 Hz are applied to the bus lines 9a and 9b, and 10a and 10b. The phases of the bias voltages applied to the bus lines 9a and 9b are opposite to these of the bias voltages applied to the bus lines 10a and 10b. Normally, the same signal is applied to the pixel electrodes 4a and 4b by the same process. The potential of the opposed electrode 7 is set to about 5 V.

A bright spot defective pixel can be recovered if the bus line 9a or 9b and the pixel electrode of one of the bright spot defective sub-pixels are short-circuited by the laser beam to change it to a dark spot defective sub-pixel. Since most of bright spot defective pixels are randomly generated, both of two sub-pixels of one pixel seldom become defective at a time. In most cases, the bright spot defective pixel can be recovered only by changing one of the bright spot defective sub-pixels to a dark spot defective sub pixel. Therefore, substantially the same display quality can be obtained as when a display operation is performed by normal pixels, even though the luminance of the pixel is reduced to half by the dark spot defective sub-pixel.

Figure 7:
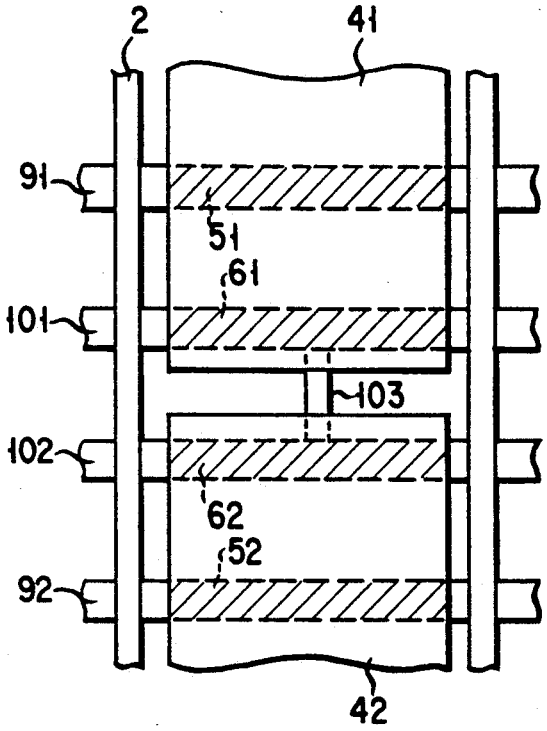
FIG. 7 is a plan view of pixels of a liquid crystal display device according to a fourth embodiment of the present invention.

FIG. 7 is a plan view of pixels of a liquid crystal display device according to the fourth embodiment of the present invention. In FIG. 7, the elements corresponding to those of the pixel of the first embodiment shown in FIGS. 1 to 3 are denoted by the same reference numerals, and their descriptions are omitted.

The fourth embodiment is a modification to the third embodiment shown in FIG. 6. In the fourth embodiment, one pixel is divided into two sub-pixels. In the third embodiment, the bus lines 10a and 10b are used in common to adjacent sub-pixels, and the capacitances of an overlap of the bus line 10a and the pixel electrode 4a and that of the bus line 10b and the pixel electrode 4b are set equal to those of an overlap of the bus line 9a and the pixel electrode 4a and that of the bus line 9b and the pixel electrode 4b. However, a difference may be caused between the capacitances $C_{S1}$ and $C_{S2}$ by mask displacement in the process for manufacturing a TFT array. To decrease the difference in the capacitances due to the mask displacement, in the liquid crystal display device of the present invention, the width or area of the bus lines 101 and 91 of a sub-pixel 41, is equal to that of the bus lines 102 and 92 of the adjacent sub-pixel 42. Furthermore, since the bus lines 101 and 102 are connected by a bypass 103, these bus lines are electrically connected to each other and supplied with the same signal, even if part of the bus lines is disconnected. If the bypass 103 is considerably narrow, a difference between the capacitances of the capacitors 51, 52, 61 and 62 due to the mask displacement, can be eliminated, and a predetermined signal can be supplied to the bus lines 101 and 102 even when they are disconnected.

Figure 8:
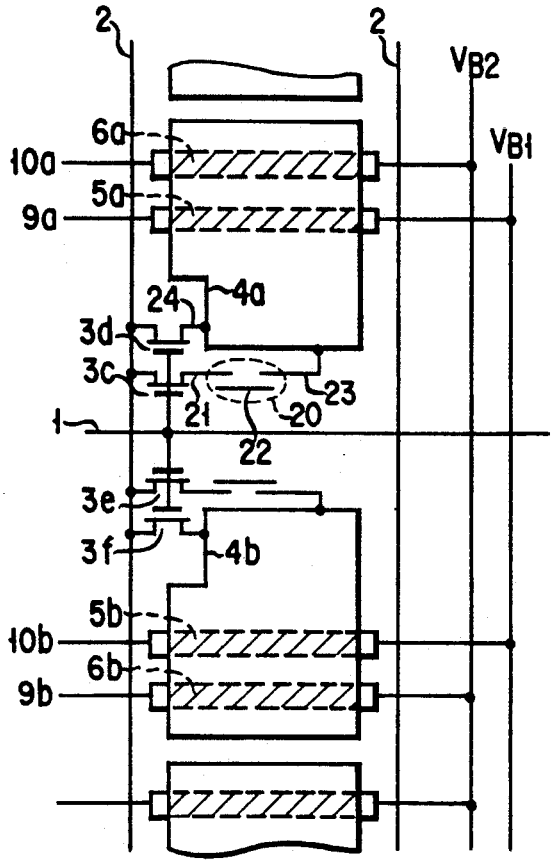
FIG. 8 is a plan view of pixels of a liquid crystal display device according to a fifth embodiment of the present invention.

FIG. 8 is a circuit diagram schematically showing pixels of a liquid crystal display device according to the fifth embodiment of the present invention. In FIG. 8, the elements corresponding to those of the pixel of the third embodiment shown in FIG. 6 are denoted by the same reference numerals, and their descriptions are omitted.

One cause of the bright spot defective pixel is a drop in pixel potential due to a defective TFT. It is difficult to distinguish the defective TFT from a normal TFT by their shapes, operations, etc. Generally, it is difficult to distinguish a bright spot defective pixel due to the defective TFT from that due to a defect in wiring connection. In the liquid crystal display device of the fifth embodiment, these two causes of the bright spot defective pixels can easily be distinguished from each other, and the defective pixels can be recovered in accordance with the causes.

Figure 9:
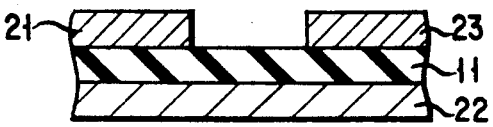
FIG. 9 is a view for explaining a connection of a thin-film transistor and a pixel electrode.
Figure 10:
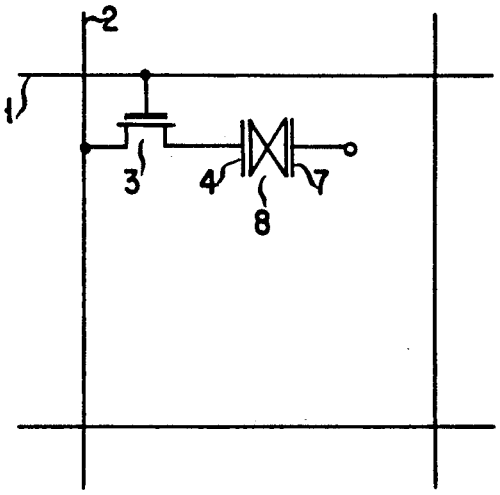
FIG. 10 (PRIOR ART)
FIG. 10 is a view of an equivalent circuit of a conventional active matrix liquid crystal display device.

The liquid crystal display device of the fifth embodiment differs from that of the third embodiment in that each of the sub-pixels has two TFTs. The sub-pixel electrode 4*a* includes TFTs 3*d* and 3*c*. The TFT 3*d* is electrically connected to the pixel electrode 4*a*, and the TFT 3*c* is connected to the pixel electrode 4*a* via a connection wiring structure 20, but usually the TFT 3*c* is not electrically connected thereto. As shown in FIG. 9, a wiring layer 21 connected to the TFT 3*c* and a wiring layer 23 connected to the pixel electrode 4*a* are formed opposite to a connection wiring layer 22 with the insulating film 11 interposed therebetween. Similarly, the pixel sub-electrode 4*b* includes TFTs 3*e* and 3*f*.

In the liquid crystal display device according to the fifth embodiment, a bright spot defective pixel is recovered as follows. Assume that the bright spot defective pixel is generated by a voltage drop in the pixel electrode 4*a*.

A wiring layer 24 connecting the TFT 3*d* and pixel electrode 4*a* is cut by the use of a laser to determine with the eye whether the voltage of the pixel electrode 4*a* has been dropped by a defect in the TFT 3*d*. If the bright spot defective pixel has been generated by the TFT 3*d*, a laser beam is emitted from the undersurface of the substrate 13 to connect the wiring layer 21 and connection wiring layer 22 and to connect the connection wiring layer 22 and wiring layer 23, thereby controlling the voltage of the pixel electrode 4*a* by the TFT 3*c*. If the bright spot defective pixel has not been generated by the TFT 3*d*, or if it is generated even by the connection of the TFT 3*c* and pixel electrode 4*a*, one of two bus lines 9*a* and 9*b* are connected to the pixel electrode 4*a* using the laser to change the bright spot defective pixel to a dark spot defective pixel.

In the liquid crystal display device according to the fifth embodiment, the bright spot defective pixel due to not only a defect in connection of the wiring layers, but also a defect in characteristics of the TFTs, can easily be recovered.

The pulse voltages whose phases are opposite to each other, have to be applied to the two bus lines 9*a* and 10*a*. However, when the operation to recover the bright spot defective pixels is not necessary, i.e., when no bright spot defective pixels are generated, no pulse voltage can be applied to the two bus lines or a predetermined direct current voltage can be applied thereto, with the result that power consumption of the device can be lowered.

The present invention has the advantage that, if a bright spot defective pixel is generated by the short circuit of the capacitors through a pin hole of the insulating film of the capacitors, it is automatically changed to a dark spot defective pixel without using the laser beam.

The present invention is not limited to the above embodiments. In the above embodiments, the potential of the opposed electrode is fixed. However, the present invention can be applied to a liquid crystal display device in which the potential of an opposed electrode is varied along scanning lines or frames. The pulse voltages whose phases are opposite to each other have only to be modulated so that the effect of two bus lines upon the potential of the pixel electrode is equal to that of one bus line. More specifically, the amplitudes and central voltages of the pulse voltages have only to be set to prevent a pulse bias of the bus lines from affecting the potential of the pixel electrode when a signal voltage is 0 V.

The liquid crystal display devices according to the above embodiments are all black-and-white displays. However, the present invention can be applied to a color display using color filters. When one pixel is constituted of unit pixels of red, blue and green in the color display, or of sub-pixels as in the third embodiments, the unit pixels other than a defective unit pixel can be also changed to dark spot unit pixels. If only the defective unit pixel or sub-pixel is recovered, the balance of color is lost, and the display quality may be degraded. Therefore, normal unit pixels can be changed to dark spot unit pixels when the need arises to prevent the display quality from being degraded.

Further, the present invention can be applied to a liquid crystal display device using a three-terminal switching element or a two terminal switching element other than a TFT.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An active matrix liquid crystal display device in a normally white mode, having a plurality of pixels including a defective pixel having been indicative of a bright spot defect, comprising:

a matrix array substrate;

an opposed substrate;

a liquid crystal layer interposed between said matrix array substrate and said opposed substrate;

an opposed electrode interposed between said opposed substrate and said liquid crystal layer;

a plurality of pixel electrodes interposed between said matrix array substrate and said liquid crystal layer so as to correspond to said plurality of pixels;

a plurality of switching elements connected to said plurality of pixel electrodes, respectively;

transmission means for transmitting an address signal to said plurality of switching elements to drive said plurality of switching elements;

first and second bus lines arranged to correspond to said plurality of pixel electrodes, said first and second bus lines each having an opposed portion which is opposed to each of said plurality of pixel electrodes through an insulating film;

first voltage applying means for applying a first voltage to said first bus line;

second voltage applying means for applying a second voltage to said second bus line; and short-circuit means for connecting a pixel electrode corresponding to said defective pixel and the opposed portion of said first bus line, wherein said first and second voltages are in antiphase and satisfy an equation of $C_1 \cdot V_{01} = C_2 \cdot V_{02}$, where $V_{01}$ and $V_{02}$ indicate amplitudes of the first and second voltages, respectively, and $C_1$ and $C_2$ indicate capacitances between the opposed portion of said first bus line and the pixel electrode and between the oppose portion of said second bus line and the pixel electrode.

2. The device according to claim 1, wherein said first and second voltages are alternating current voltages whose phases differ from each other by 180° and satisfy an equation of $C_1 \cdot V_1 = C_2 \cdot V_2$, where $V_1$ and $V_2$ denote said first and second voltages.

3. The device according to claim 1, wherein said first bus line and said insulating layer are formed of material which is melted by a laser beam, and said short-circuit means is formed of a melt of part of said first bus line.

4. The device according to claim 1, wherein said opposed portion of said first bus line is narrower than said opposed portion of said second bus line, therefore, $C_{S1} < C_{S2}$ and $V_{01} > V_{02}$.

5. The device according to claim 1, wherein said plurality of pixels each include a plurality of sub-pixels each having one pixel electrode.

6. The device according to claim 5, wherein said second bus line has a width enough to overlap pixel electrodes of adjacent two pixels, and said opposed portions corresponding to the pixel electrodes of said adjacent two pixels are formed on both sides of said second bus lines.

7. The device according to claim 5, wherein said opposed portions of the second bus lines corresponding to the pixel electrodes of said adjacent two pixels are connected by a line perpendicular to said second bus lines.

8. An active matrix liquid crystal display device in a normally white mode, having a plurality of pixels, comprising:

a matrix array substrate;

an opposed substrate;

a liquid crystal layer interposed between said matrix array substrate and said opposed substrate;

an opposed electrode interposed between said opposed substrate and said liquid crystal layer;

a plurality of pixel electrodes interposed between said matrix array substrate and said liquid crystal layer so as to correspond to said plurality of pixels;

a plurality of switching elements connected to said plurality of pixel electrodes, respectively;

transmission means for transmitting an address signal to said plurality of switching elements to drive said plurality of switching elements;

first and second bus lines arranged to correspond to said plurality of pixel electrodes, said first and second bus lines each having an opposed portion which is opposed to each of said plurality of pixel electrodes through an insulating film;

first voltage applying means for applying a first voltage to said first bus line; and second voltage applying means for applying a second voltage to said second bus line;

wherein said first and second voltages are in antiphase and satisfy an equation of $C_1 \cdot V_{01} = C_2 \cdot V_{02}$, where $V_{01}$ and $V_{02}$ indicate amplitudes of the first and second voltages, respectively, and $C_1$ and $C_2$ indicate capacitances between the opposed portion of said first bus line and the pixel electrode and between the opposed portion of said second bus line and the pixel electrode.

9. The device according to claim 8, wherein said first and second voltages are alternating current volt ages whose phases differ from each other by 180° and satisfy an equation of $C_1 \cdot V_1 = C_2 \cdot V_2$, where $V_1$ and $V_2$ denote said first and second voltages.

10. The device according to claim 8, wherein said first bus line and said insulating layer are formed of material which is melted by a laser beam.

11. The device according to claim 8, wherein said opposed portion of said first bus line is narrower than said opposed portion of said second bus line, therefore, $C_{S1} < C_{S2}$ and $V_{01} > V_{02}$.

12. The device according to claim 8, wherein said plurality of pixels each include a plurality of sub-pixels each having one pixel electrode.

13. The device according to claim 12, wherein said second bus line has a width enough to overlap pixel electrodes of adjacent two pixels, and said opposed portions corresponding to the pixel electrodes of said adjacent two pixels are formed on both sides of said second bus lines.

14. The device according to claim 12, wherein said opposed portions of the second bus lines corresponding to the pixel electrodes of said adjacent two pixels are connected by a line perpendicular to said second bus lines.

* * * * *